US006708824B2

(12) United States Patent
Sahm, III

(10) Patent No.: US 6,708,824 B2
(45) Date of Patent: Mar. 23, 2004

(54) STACKABLE AND NESTABLE CONTAINER

(75) Inventor: Victor A. Sahm, III, Dallas, TX (US)

(73) Assignee: Southwest Agri-Plastics, Inc., Addison, TX (US)

( * ) Notice: Subject to any disclaimer, the term of this patent is extended or adjusted under 35 U.S.C. 154(b) by 94 days.

(21) Appl. No.: 09/993,273

(22) Filed: Nov. 16, 2001

(65) Prior Publication Data

US 2003/0094393 A1 May 22, 2003

(51) Int. Cl.[7] ..... B65D 6/38
(52) U.S. Cl. ..... 206/505; 206/519; 220/671
(58) Field of Search ..... 206/505, 515, 206/516, 517, 519; 220/671

(56) References Cited

U.S. PATENT DOCUMENTS

| | | | | | |
|---|---|---|---|---|---|
| 3,005,572 | A | * | 10/1961 | Gustafson et al. | 220/671 |
| 3,035,623 | A | | 5/1962 | Goetz | |
| 3,055,529 | A | | 9/1962 | Cameron et al. | |
| 3,443,714 | A | * | 5/1969 | Edwards | 220/671 |
| 3,804,289 | A | | 4/1974 | Churan | |
| D236,320 | S | | 8/1975 | Renou | |
| 3,901,406 | A | * | 8/1975 | Kivett | 220/8 |
| 4,014,452 | A | | 3/1977 | Galer | |
| 4,257,527 | A | | 3/1981 | Snyder et al. | |
| 4,473,165 | A | * | 9/1984 | Lentjes | 220/659 |
| D285,498 | S | | 9/1986 | Thibault | |
| D294,749 | S | | 3/1988 | Fuller | |
| D296,948 | S | | 7/1988 | Fuller | |
| 4,995,528 | A | | 2/1991 | Sharp | |
| 5,071,028 | A | | 12/1991 | Murphy | |
| 5,105,947 | A | | 4/1992 | Wise | |
| D337,181 | S | | 7/1993 | Warman | |
| 5,226,558 | A | | 7/1993 | Whitney et al. | |
| D340,553 | S | | 10/1993 | Sahm, Jr. | |
| D353,914 | S | | 12/1994 | Sahm, Jr. | |
| 5,415,339 | A | * | 5/1995 | Howard | 229/403 |
| 5,685,453 | A | * | 11/1997 | Goins et al. | 220/782 |
| 5,758,791 | A | * | 6/1998 | Mangla | 220/4.21 |

* cited by examiner

*Primary Examiner*—Joseph Man-Fu Moy
(74) *Attorney, Agent, or Firm*—Gardere Wynne Sewell LLP

(57) ABSTRACT

A vertically stackable and nestable tub-like container is preferably formed of injection molded plastic and includes a circumferential sidewall formed with alternate inwardly and outwardly facing channel portions. Outwardly facing channel portions taper outwardly from a peripheral rim defining the upper edge of the container toward the bottom edge of the sidewall. The bottom edge of the sidewall is joined to a bottom wall by a curved intermediate wall portion and the bottom edge of the sidewall extends slightly beyond the bottom wall of the container for transferring forces acting on the sidewall directly to a support surface. Circumferentially spaced axially extending anti-nesting stops and reinforcing ribs extend along the outwardly facing channel portions of the sidewall.

15 Claims, 5 Drawing Sheets

STACKABLE AND NESTABLE CONTAINER

BACKGROUND OF THE INVENTION

Lightweight, plastic containers are used in myriad applications. However, certain applications demand or make desirable particular features of containers. For example, in the high-volume production of animal feed supplements and similar materials, it is desirable to provide containers which are nestable, particularly when empty, and are also vertically stackable when filled with the material for which the container is designed. Flowable animal feed supplements are often containerized at a relatively high temperature of the supplement material. Filling molded plastic containers at elevated temperatures of the material disposed in the containers tends to weaken the containers and prevent stacking the containers one on top of the other, since the lower-most or at least lower ones of the containers in the stack tend to deform under the weight of the containers stacked above.

Of course, prior to filling containers, it is desirable to minimize the space occupied by such items by nesting the containers one inside the other while also providing for easy separation of the containers as they are processed to be filled with the material they are to contain. Accordingly, certain engineering problems have persisted in the development of nestable and stackable containers used for various applications, including the application mentioned hereinabove. It is to overcome the problems associated with prior art containers that the present invention has been developed.

SUMMARY OF THE INVENTION

The present invention provides an improved nestable and stackable container, particularly one formed of molded plastic and being adapted to contain relatively high-density material, which may be loaded into the container at an elevated temperature.

In accordance with one aspect of the present invention, a nestable and stackable container is provided which comprises a molded plastic bucket or tub which includes, in combination, an improved sidewall configuration which adds strength to the container, particularly for applications wherein filled containers are vertically stacked one on top of the other. The container sidewall is also joined to a bottom wall of the container in a manner which allows transfer of forces acting on the container through the sidewall directly to a surface supporting the container in a manner which resists or reduces the likelihood of bulging of the container at the juncture between the sidewall and bottom wall. Moreover, the configuration of the sidewall also enhances the nestability and vertical stackability of the container.

In accordance with another aspect of the invention, a stackable and nestable container is provided which is preferably formed of molded plastic, includes a sidewall which is characterized by alternate, inwardly facing and outwardly facing channel portions, the channel portions being tapered, generally from a top edge of the container to a bottom edge of the container sidewall. Still further, the outwardly facing channel portions may be reinforced by a vertical, generally central rib extending along each of the outwardly facing channel portions.

Still further, the present invention provides a container with improved nestability provided by a sidewall with alternate inward and outward facing channel portions which are tapered from, generally, a top edge of the container toward a bottom wall of the container and with circumferentially-spaced nesting stops dimensioned to limit the amount of insertion of one container within the other.

Those skilled in the art will further appreciate the above-mentioned advantages and superior features of the container of the present invention upon reading the detailed description, which follows in conjunction with the drawing.

DETAILED DESCRIPTION OF A PREFERRED EMBODIMENT

Figure 1A:
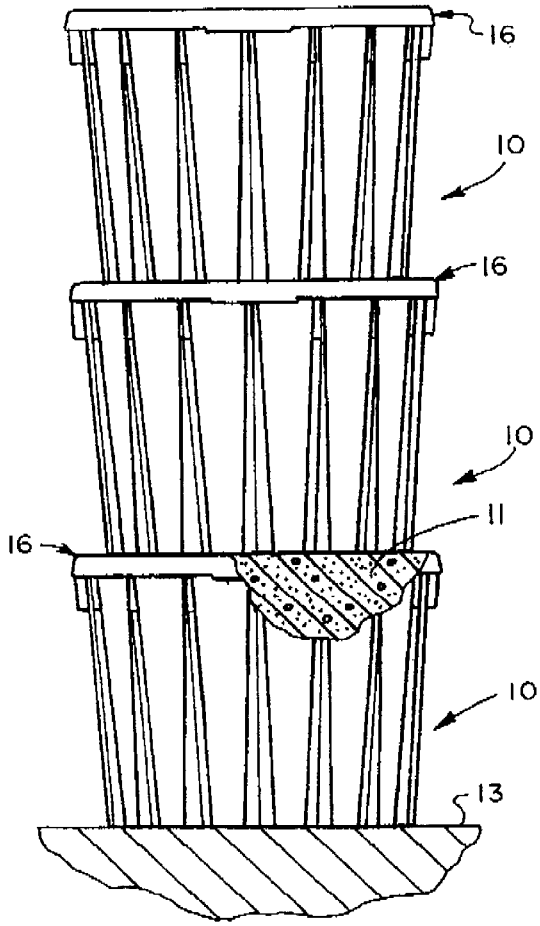
FIG. 1A is a side elevation showing plural, filled containers of the present invention vertically stacked one on top of the other.

In the description which follows, like parts are marked throughout the specification and drawing with the same reference numerals, respectively. The drawing figures may not be to scale in the interest of clarity and conciseness.

Figure 1B:
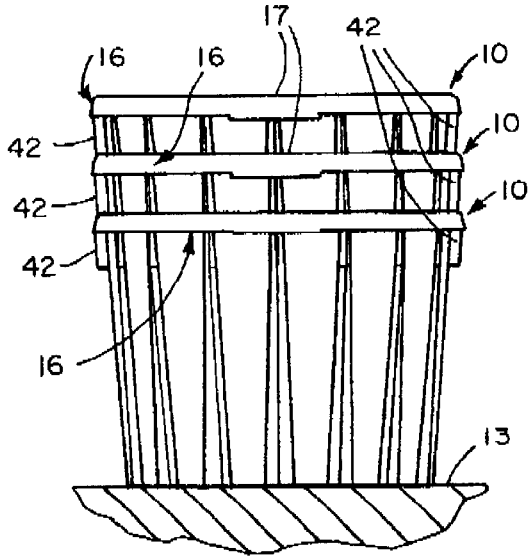
FIG. 1B is a side elevation of plural ones of the container of the present invention nested one within the other when empty.

Referring to FIGS. 1A and 1B, there is illustrated an improved, nestable and stackable container in accordance with the invention and generally designated by the numeral 10. In FIG. 1A, plural, filled containers 10 are shown stacked vertically one on top of the other. The containers 10 as shown in FIG. 1A may be separated by a thin partition, not shown, be each provided with a top cover, not shown, or be filled with a solid material 11 so that the containers may be vertically stacked by resting the bottom-most container 10 on a firm surface 13 while resting the intermediate container and the uppermost container on the solidified material of the container below and for which the containers have been filled, respectively.

As shown in FIG. 1B, the containers 10 may be, when empty, nested one within the other to substantially reduce the space occupied by the containers.

Figure 2:
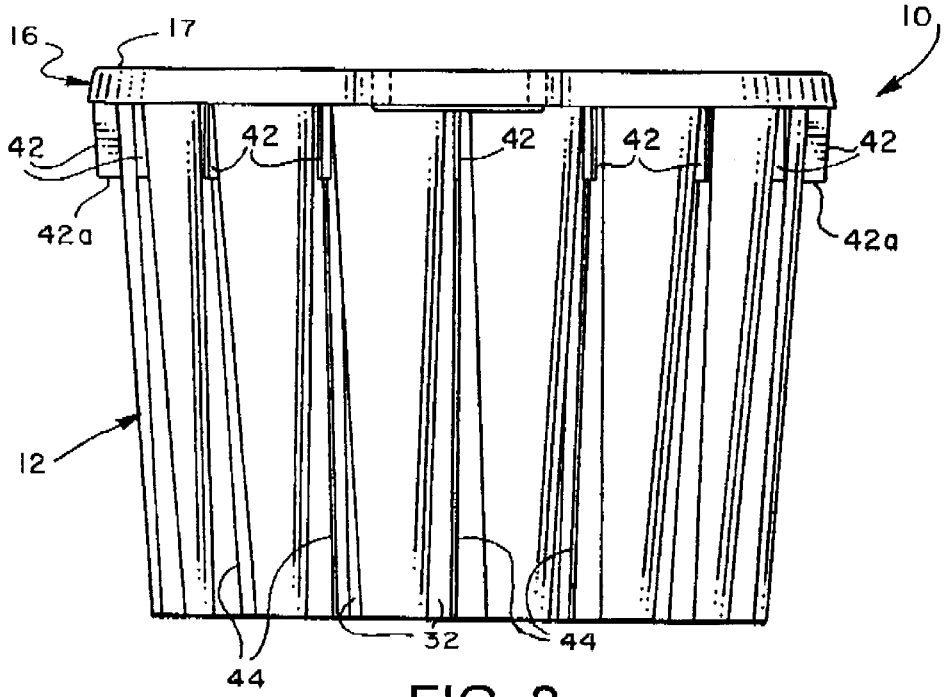
FIG. 2 is a side elevation of the container of the present invention on a larger scale.
Figure 4:
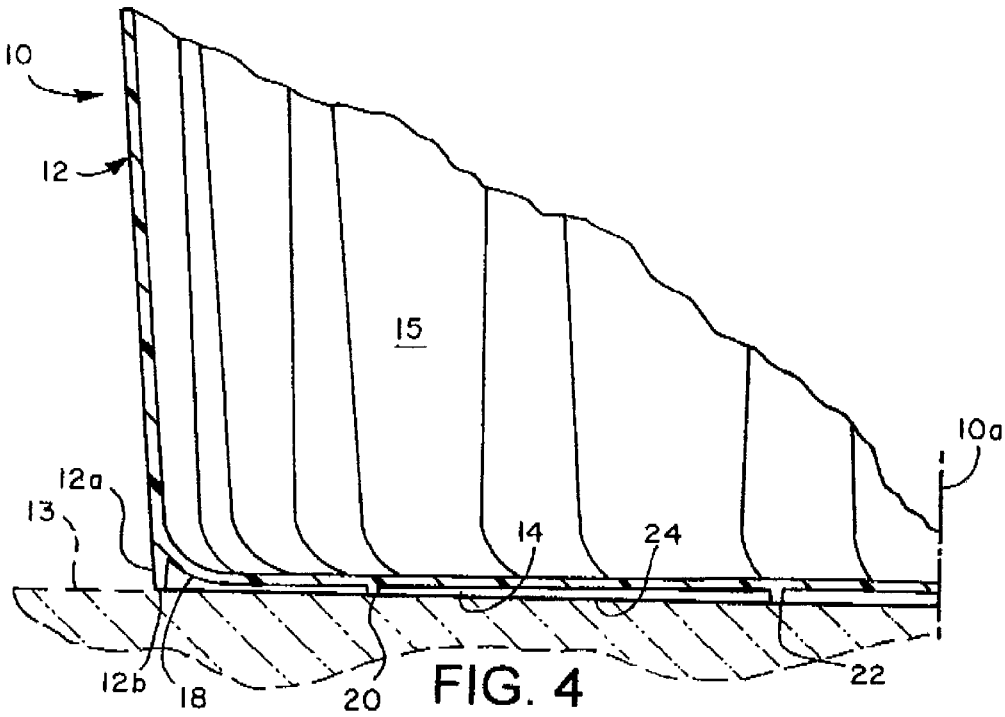
FIG. 4 is a detail section view taken generally along the line 4—4 of FIG. 3.
Figure 3:
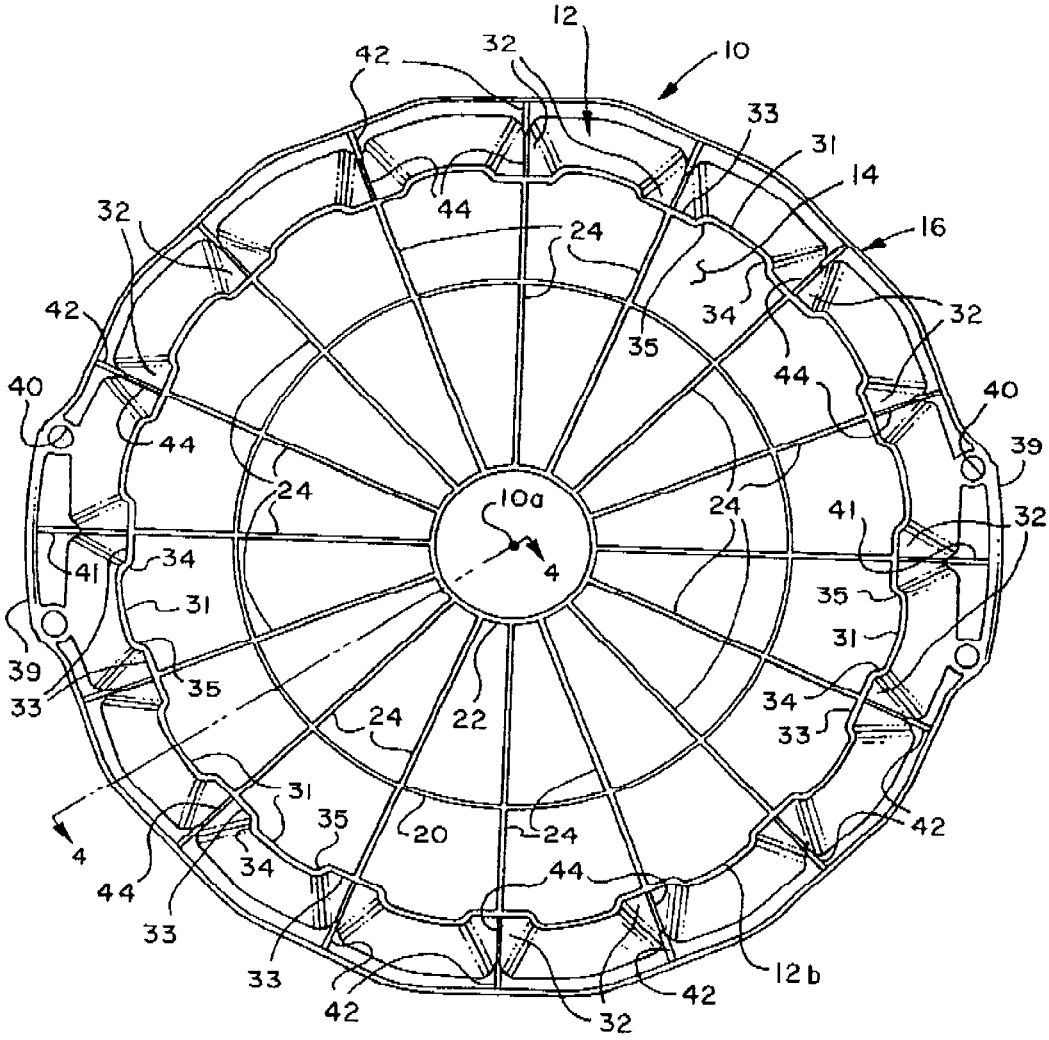
FIG. 3 is a bottom plan view of the container.

Referring now to FIGS. 2, 3 and 4, each of the containers 10 includes a peripheral sidewall 12, a bottom wall 14, FIGS. 3 and 4, and a top edge delimited by a circumferential rim 16, FIGS. 2 and 3. As shown in FIG. 4, the bottom wall 14 is joined to sidewall 12 by a curved transition portion 18 and, as shown in FIGS. 3 and 4, bottom wall 14 is reinforced by downwardly facing outer and inner circumferential concentric ribs 20 and 22. Circumferentially-spaced, radially extending ribs 24, FIGS. 3 and 4, extend from the rib 22 radially outwardly to the sidewall 12. The height of ribs 20, 22 and 24 is such as to extend to a plane which is coplanar with surface 13 so that forces exerted on the bottom wall 14 are transferred through the ribs 20, 22 and 24 to a supporting surface for the container 10. Still further, as shown in FIG. 4, the sidewall 12 includes a depending portion 12*a* depending below the point of tangency of the sidewall with the curved, intermediate or transition portion 18 to an edge 12*b* and which is coplanar with ribs 20, 22 and 24, so that generally vertical forces acting on the sidewall 12 may also be transferred to a support surface, such as the surface 13.

Figure 5:
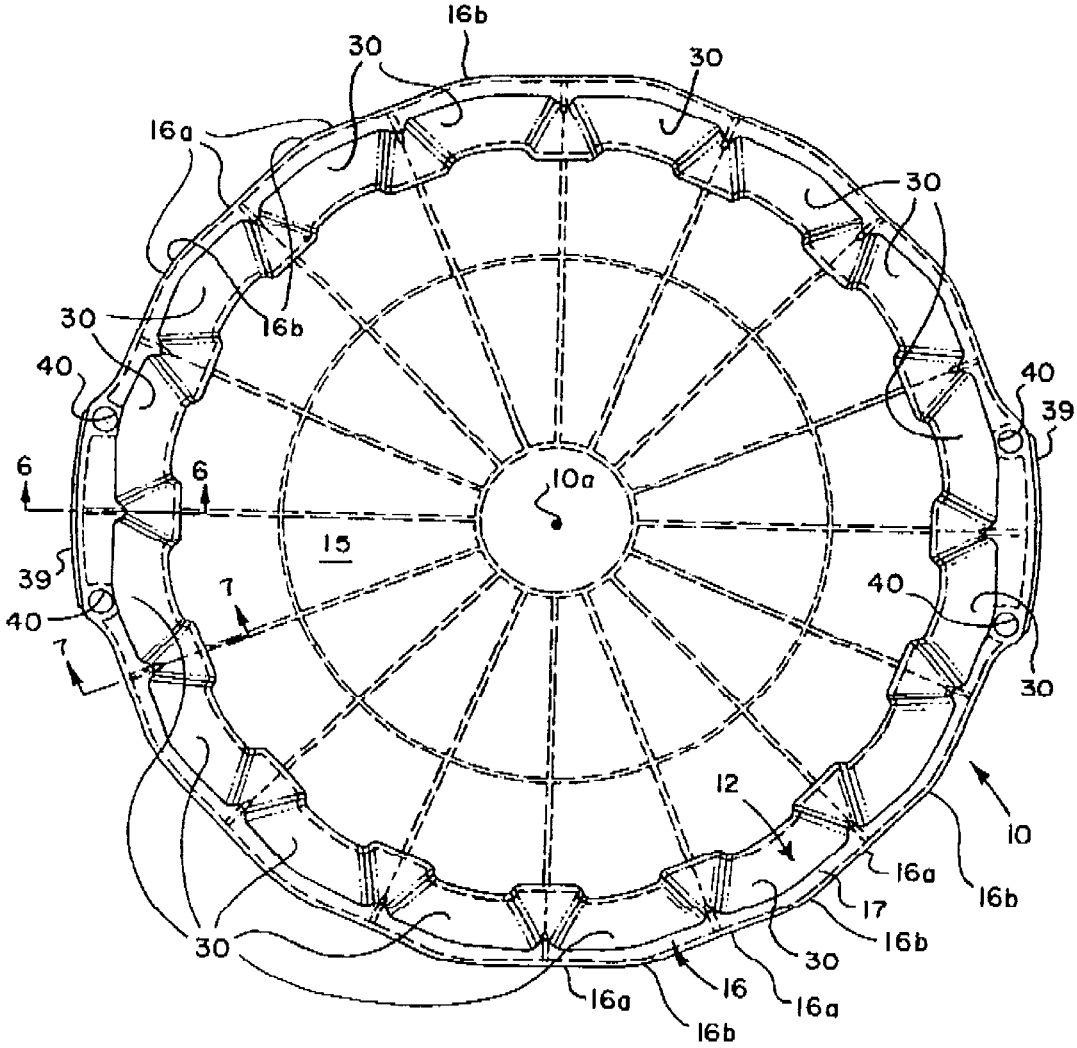
FIG. 5 is a top plan view of the container of the present invention.

Referring further to FIGS. 2, 3 and 4, the container 10 defines an interior space 15, FIGS. 4 and 5, which may be filled with material to a top edge 17, FIGS. 2 and 5, defined by the peripheral rim 16. As shown in FIGS. 2, 3 and 5, the sidewall 12 is characterized by alternating radially inwardly and outwardly facing channel portions 30 and 32. Channel portions 30 are formed by circumferentially extending tapered wall segments 31, FIG. 3, while channel portions 32 are formed by corresponding circumferentially extending spaced apart and tapered wall segments 33. Wall segments 31 and 33 are joined by curved intermediate wall portions 34 and 35, FIG. 3. Channel portions 32 taper outwardly generally from rim 16 to sidewall bottom edge 12*b* and, accordingly, channel portions 30 taper inwardly from peripheral rim 16 to sidewall bottom edge 12*b*. For a container having a diameter of approximately eighteen inches, a height of approximately eighteen inches and a capacity of approximately twenty-three U.S. gallons, sixteen sidewall channel portions 30 and 32 are provided, respectively.

Figure 6:
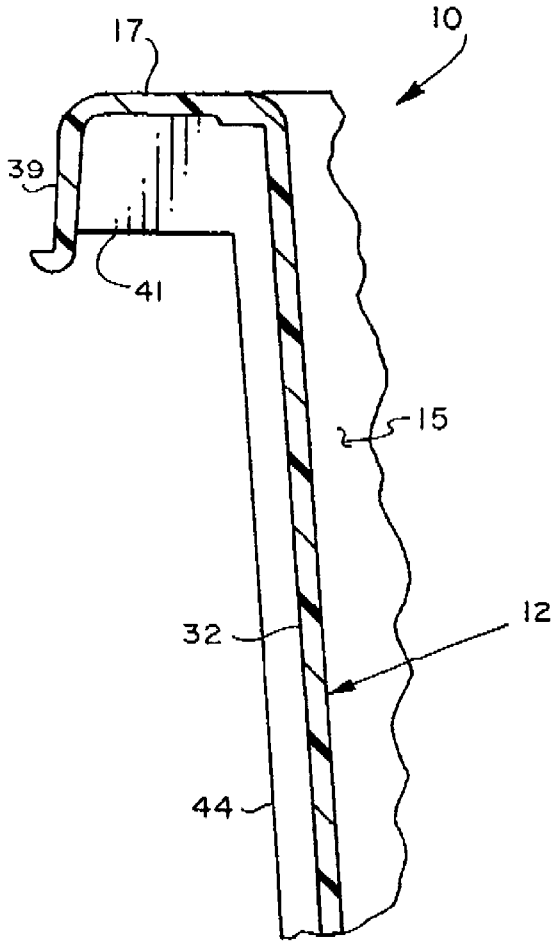
FIG. 6 is a detail section view taken generally along the line 6—6 of FIG. 5.
Figure 7:
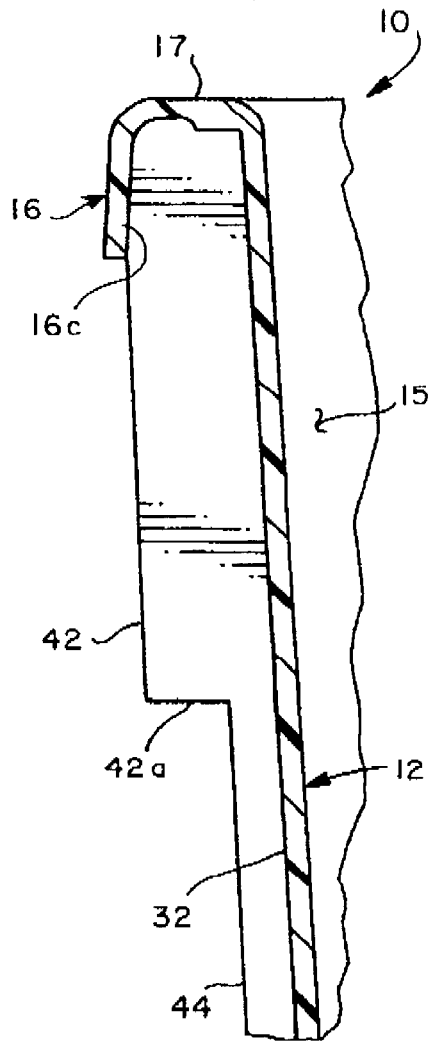
FIG. 7 is a detail section view taken generally along the line 7—7 of FIG. 5.

Referring now primarily to FIGS. 5, 6 and 7, container 10 is provided with opposed handle portions 39, FIG. 5, which are formed integral with the peripheral rim 16 and are opposed about 180° degrees with respect to each other. Spaced apart openings 40 are provided in each handle portion 39 for securing a tote rope, or the like, not shown. A central radially extending handle reinforcing rib 41 is provided for each handle portion 39, FIGS. 3 and 6. As shown in FIG. 5, peripheral rim 16 is not completely circular, but is characterized by somewhat linear segments 16*a*, each of which is joined to an adjacent linear segment by a short curved segment 16*b*. Linear segments 16*a* are aligned generally with the centerline of the tapered channel portions 32. As shown in FIG. 7, peripheral rim 16 includes a down-turned flange 16*c* spaced from sidewall 12 about the circumference of the container 10. Circumferentially spaced, axially extending, rib-like anti-nesting stops 42, one shown in FIG. 7, extend from top edge 15 downwardly a pre-determined distance to a stop surface 42*a*. Accordingly, when containers 10 are nested one within the other, as shown in FIG. 1B, the stop surfaces 42*a* of one container engage the top edge 17 of the container in which it is nested to limit the extent of such nesting and prevent one container from wedging or sticking inside another container.

Still further, the channel portions 32 are each reinforced by a central rib 44, FIGS. 3 and 7, which extends downwardly from and is coplanar with each of the anti-nesting stops 42, respectively, and preferably to the bottom edge 12*b* of sidewall 12. Accordingly, wall segments 33 are reinforced by the ribs 44 and the anti-nesting ribs or stops 42, respectively. Respective ribs 44 are provided coplanar with the respective ribs 41 also, see FIG. 6 by way of example. Moreover, by providing the tapered channel portions 30 and 32, the sidewall 12 of container 10 is also reinforced against both radial bulging as well as axial buckling in the direction of central axis 10*a* of container 10, when plural containers are stacked one on top of the other, as shown in FIG. 1A, and are full of relatively dense material at elevated temperatures, in particular. The depths or radial widths of the ribs 44 are preferably less than the depths of the channel portions 32 so as to not interfere with the nestability of the container 10.

A container 10 having the capacity and general dimensions as mentioned above is preferably formed of relatively high-density polyethylene. The thicknesses as of the sidewall 12, the bottom wall 14, and the peripheral rim 16 are, preferably, approximately 0.125 inches to 0.130 inches and the stops 42 and ribs 44 are, preferably, approximately 0.10 inches thick. The container 10 may be formed as an integral structure in its entirety in substantially one operation by an injection molding process of a type well known. Thanks to the configuration of the sidewall 12, the bottom wall 14, and the stops and ribs 42 and 44, the container 10 has demonstrated superior vertical stackability as compared with prior art containers having generally cylindrical sidewalls. The taper of the sidewall 12 with respect to a central axis 19 of the container 10 is, preferably, approximately four degrees outwardly from the bottom wall 14 to the peripheral rim 16.

The manufacture and use of the container 10 is believed to be readily understandable to those of skill in the art based on the foregoing description. Although a preferred embodiment of a superior nestable and stackable container has been described herein, those skilled in the art will also recognize that various substitutions and modifications may be made without departing from the scope and spirit of the appended claims.

What is claimed is:

1. A nestable and stackable container comprising:

a bottom wall;

a generally cylindrical circumferential sidewall integrally joined to said bottom wall;

a peripheral rim integrally joined to said sidewall at an end of said container opposite said bottom wall;

said sidewall being formed with circumferentially spaced alternating inward and outwardly facing channel portions to reinforce said container for vertically stacking containers one on top of the other, said channel portions are formed by generally circular segments of said sidewall, which are joined to each other by intermediate curved segments, respectively, and said inwardly facing channel portions are tapered outwardly from said bottom wall toward said peripheral rim.

2. The container set forth in claim 1 including:

circumferentially spaced axially extending anti- nesting stops integrally formed with said sidewall and including a stop surface engageable with a top edge of another container in which said container is nested.

3. The container set forth in claim 1, including:

axially-extending circumferentially spaced ribs extending along at least one of said inwardly and outwardly facing channel portions of said sidewall.

4. The container set forth in claim 3 wherein:

said ribs extend along and are integrally joined to said sidewall at said outwardly facing channel portions.

5. The container set forth in claim 1 wherein:

said sidewall is joined to said bottom wall by a curvilinear intermediate part and said sidewall includes a bottom edge extending from said curvilinear part and engageable with a support surface for said container to transfer forces from said sidewall directly to said support surface.

6. The container set forth in claim 1 wherein:

said peripheral rim includes a depending flange spaced from said sidewall.

7. The container set forth in claim 6, including:

opposed handle portions integrally formed with said peripheral rim.

8. The container set forth in claim 6 wherein:

said peripheral rim comprises circumferentially spaced linear portions joined together by plural curved portions.

9. A nestable and stackable container comprising:

a bottom wall;

a generally cylindrical circumferential sidewall integrally joined to said bottom wall;

a peripheral rim integrally joined to said sidewall at an end of said container opposite said bottom wall;

said sidewall being formed with circumferentially spaced alternating inward and outwardly facing channel portions to reinforce said container for vertically stacking containers filled with material one on top of the other, said inwardly facing channel portions are tapered outwardly from said bottom wall toward said peripheral rim, and said channel portions are formed by generally circular segments of said sidewall, which are joined to each other by intermediate curved segments, respectively;

circumferentially spaced anti-nesting stops including respective stop surfaces formed thereon; and said sidewall is joined to said bottom wall by a curvilinear intermediate part and said sidewall includes a continuous peripheral bottom edge extending from said curvilinear part and engageable with a support surface for said container to transfer forces from said sidewall directly to said support surface.

10. The container set forth in claim 9, including:

elongated ribs extending axially along and integrally joined to said sidewall at said outwardly facing channel portions.

11. The container set forth in claim 9 wherein:

said peripheral rim includes a depending flange spaced from said sidewall.

12. The container set forth in claim 11, including:

opposed handle portions integrally formed with said peripheral rim.

13. The container set forth in claim 11 wherein:

said peripheral rim comprises circumferentially spaced linear portions joined together by plural curved portions of said flange.

14. A nestable and stackable container comprising:

a bottom wall;

a generally cylindrical circumferential sidewall integrally joined to said bottom wall by a curvilinear intermediate wall part, said sidewall including a bottom edge extending from said curvilinear wall part and engageable with a support surface for said container;

a peripheral rim integrally joined to said sidewall at an end of said container opposite said bottom wall;

said sidewall being formed with circumferentially spaced alternating inward and outwardly facing channel portions to reinforce said container for vertically stacking containers filled with material one on top of the other, said inwardly facing channel portions are tapered outwardly from said bottom wall toward said peripheral rim, and said channel portions are formed by generally circular segments of said sidewall, which are joined to each other by intermediate curved segments, respectively;

elongated ribs extending along said sidewall at said outwardly facing channel portions, respectively, between said bottom wall and said peripheral rim; and circumferentially spaced anti-nesting stops integrally formed with said sidewall, each including a stop surface engageable with a surface of another container in which said container is nested.

15. A nestable and stackable container comprising:

a bottom wall;

a generally cylindrical circumferential sidewall integrally joined to said bottom wall;

said sidewall being formed with circumferentially spaced alternating inward and outwardly facing channel portions to reinforce said container for vertically stacking containers one on top of the other;

a peripheral rim integrally joined to said sidewall at an end of said container opposite said bottom wall, said peripheral rim comprises circumferentially spaced linear portions joined together by plural curved portions and a depending flange spaced from said sidewall; and opposed handle portions integrally formed with said peripheral rim.

* * * * *